US007181813B2

(12) United States Patent
Chen

(10) Patent No.: US 7,181,813 B2
(45) Date of Patent: Feb. 27, 2007

(54) LOW-PROFILE HEAVY-DUTY BUCKLE

(75) Inventor: Tsung-Lung Chen, Taipei (TW)

(73) Assignee: Button International Co., Ltd., Taipei (TW)

( * ) Notice: Subject to any disclaimer, the term of this patent is extended or adjusted under 35 U.S.C. 154(b) by 0 days.

(21) Appl. No.: 10/958,366

(22) Filed: Oct. 6, 2004

(65) Prior Publication Data

US 2005/0076483 A1 Apr. 14, 2005

(30) Foreign Application Priority Data

Oct. 9, 2003 (TW) ..... 92218089 U

(51) Int. Cl.
*A44B 11/26* (2006.01)

(52) U.S. Cl. ..... 24/625

(58) Field of Classification Search ..... 24/614–616, 24/625; D11/200, 216, 218
See application file for complete search history.

(56) References Cited

U.S. PATENT DOCUMENTS 5,465,472 A * 11/1995 Matoba ..... 24/625
6,052,875 A * 4/2000 Fudaki ..... 24/625

FOREIGN PATENT DOCUMENTS

JP 07155207 A * 6/1995
JP 2001218606 A * 8/2001

* cited by examiner

*Primary Examiner*—James R. Brittain
(74) *Attorney, Agent, or Firm*—Troxell Law Office, PLLC

(57) ABSTRACT

A low-profile heavy-duty buckle includes a male member having two forward elastic retaining arms, and a female member having two receiving spaces corresponding to the retaining arms of the male member. The retaining arm is elastically exposed from and retained to a side opening provided on a sidewall of the receiving space when the male member is plugged into the female member. The retaining arm further includes an inward extended extension portion having a first retaining block with a first toothed face provided near a distal end thereof. The receiving space is internally provided with a downward extended second retaining block having a second toothed face opposite to the first toothed face. The first and the second toothed face firmly engage with one another to provide the buckle with an enhanced force-bearing strength when the connected male and female members are subjected to two opposite pull forces.

9 Claims, 2 Drawing Sheets

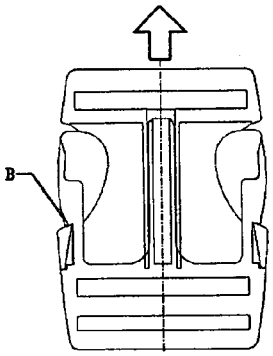
1
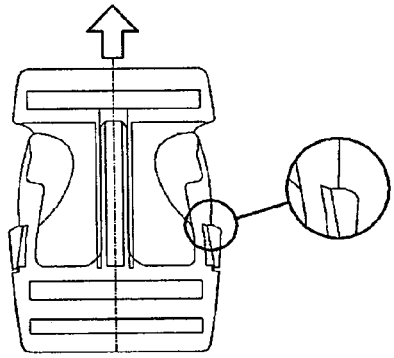
2
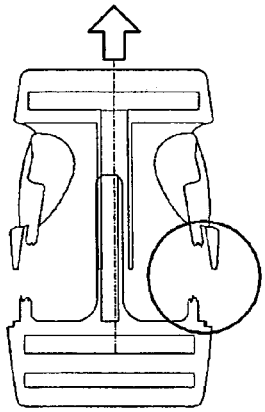
3

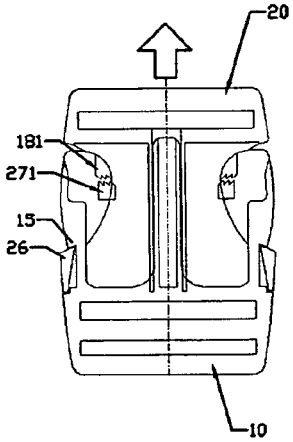
4
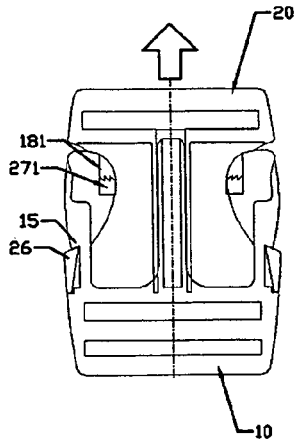
5
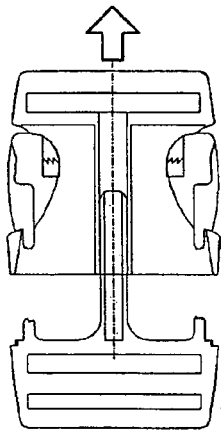
6

LOW-PROFILE HEAVY-DUTY BUCKLE

FIELD OF THE INVENTION

The present invention relates to a low-profile heavy-duty buckle, and more particularly to a low-profile heavy-duty buckle having increased force-bearing strength when male and female members thereof are engaged with each other.

BACKGROUND OF THE INVENTION

Buckles are widely employed on various apparels and articles, such as backpacks, to detachably connect two ends of a fastening belt. Such buckles usually include a male and a female member connected to the two ends of the fastening belt. By engaging or disengaging the male and female members with or from each other, or depressing or releasing a push element, the two ends of the fastening belt could be connected or separated under control. In addition to control the connection or separation of the two ends of the fastening belt, the buckle also serves as a major supporting means when the fastening belt is subjected to an external force.

In a conventional low-profile buckle, the male member typically includes a plug head portion and the female member a receiving space corresponding to the plug head. The plug head portion includes two spaced elastic arms, which elastically shift inward when entering the receiving space of the female member and elastically spring into two side openings formed on two side walls of the receiving space to firmly hold the male member to the female member. When it is desired to open the buckle, simply apply two opposite inward forces on the two elastic arms exposed from the side openings to cause separation of the elastic arms from the side openings, and then pull the male member out of the female member.

A main force-bearing structure on the conventional low-profile buckle to prevent the connected male and female members from unexpected separation from each other includes the two elastic arms of the male member and two end wall surfaces of the two side openings closer to a front end of the female member for the two elastic arms to abut thereon. Since the two elastic arms elastically exposed from the side openings are subject to inward compression and deformation to easily separate from the end wall surfaces of the side openings, the buckle tends to open unexpectedly to cause inconveniences.

SUMMARY OF THE INVENTION

A primary object of the present invention is to provide a low-profile heavy-duty buckle that has increased force-bearing strength when it is in a closed state.

To achieve the above and other objects, the low-profile heavy-duty buckle of the present invention includes a male and a female member. The male member has two forward extended and spaced elastic retaining arms and a central guide arm located between them, and the female member is internally provided with two receiving spaces and a central guide channel corresponding to the retaining and central guide arms of the male member. Each of the retaining arms includes a curved outer side surface having a shoulder portion formed at a proximal end thereof. Each of the receiving spaces includes an inner sidewall surface that contacts with and pushes the curved outer side surface of the retaining arm inward when the male member is plugged into the female member, and a side opening formed on the sidewall of the receiving space and having an end wall surface adapted to abut against the shoulder portion of the retaining arm when the male member is fully plugged into the female member. The retaining arm further includes an extension portion inward extended from the curved outer side surface and having a predetermined area. A width-reduced wall and a first retaining block having a first toothed face are provided near a distal end of the extension portion to define a guide way between them. The female member is provided in the receiving space with a downward extended second retaining block having a second toothed face toward a direction opposite to the first toothed face. The first and the second toothed face firmly engage with one another to provide the buckle with an enhanced force-bearing strength when the connected male and female members are subjected to two opposite pull forces.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein FIG. 1 is an assembled perspective view of a low-profile heavy-duty buckle according to a preferred embodiment of the present invention;

FIG. 2 is an exploded perspective view of FIG. 1;

FIG. 3 is a sectional view of FIG. 2;

FIG. 4 is a sectional view showing a male member of the buckle of the present invention is initially plugged into a female member of the buckle;

FIG. 5 is a sectional view showing the male member of the buckle of the present invention is further pushed into the female member of the buckle; and FIG. 6 shows the male and the female member of the buckle of the present invention are fully coupled with one another with two pairs of opposite toothed faces thereof engaged with one another to provide an enhanced binding force between the male and the female member.

DETAILED DESCRIPTION OF THE PREFERRED EMBODIMENTS

Please refer to FIG. 1 that is an assembled perspective view of a low-profile heavy-duty buckle according to a preferred embodiment of the present invention. As shown, the buckle includes a male member 10 and a female member 20 being provided near respective rear end with a transverse long slot 11, 21 for two opposite ends of a belt (not shown) to connect thereto.

Please also refer to FIGS. 2 and 3. The male member 10 includes two spaced elastic retaining arms 12 and a central guide arm 13 forward extended from a front end thereof by a predetermined length. The female member 20 is provided at a front end with two receiving spaces 22 and a central guide channel 23 corresponding to the two retaining arms 12 and the central guide arm 13 of the male member 10, respectively, so that the male member 10 could be firmly plugged into and connected to the female member 20 to form an integral buckle.

Since the two retaining arms 12 are identical to each other, only one of them is described hereinafter. The retaining arm 12 includes a curved outer side surface 14, which is in contact with and pushed inward by an inner sidewall surface 24 of the receiving space 22 when the elastic retaining arm 12 is plugged into the receiving space 22; and a shoulder portion 15 formed at an inward reduced proximal end of the curved outer side surface 14.

Similarly, since the two receiving spaces 22 are identical to each other, only one of them is described hereinafter. The receiving space 22 includes an inner sidewall surface 24 that contacts with and pushes the curved outer side surface 14 of the retaining arm 12 of the male member 10 when the latter is plugged into the female member 20; and a side opening 25 provided between front and rear ends of the sidewall of the receiving space 22 to communicate with the receiving space 22. An end wall surface 26 of the side opening 25 closer to the front end of the female member 20 is adapted to abut against the shoulder portion 15 of the retaining arm 12 when the latter is fully plugged into the receiving space 22.

When the retaining arm 12 of the male member 10 is initially plugged into the receiving space 22 of the female member 20, the curved outer side surface 14 of the elastic retaining arm 12 is pressed against and pushed by the inner sidewall surface 24 of the receiving space 22 to shift inward. And, when the whole retaining arm 12 is fully located in the receiving space 22, the side opening 25 of the female member 20 allows the elastic retaining arm 12 to spring outward to expose the curved outer side surface 14 from the side opening 25 with the shoulder portion 15 abutted against the end wall surface 26 of the side opening 25. With the two elastic retaining arms 12 located at this position, the male member 10 and the female member 20 are connected to each other.

It is noted the retaining arm 12 further includes an extension portion 16 inward extended from the curved outer side surface 14 and having a predetermined area. The extension portion 16 is provided near a distal end with a width-reduced wall 17 adjacent to the curved outer side surface and a first retaining block 18, which are spaced from each other to define a guide way 19 between them. In the illustrated preferred embodiment, the width-reduced wall 17 is formed at an inner side of a free end with a guiding beveled surface 171, and the first retaining block 18 is formed at a rear end with a first toothed face 181.

And, the female member 20 is provided in the receiving space 22 at a position corresponding to the guide way 19 with a downward extended second retaining block 27. A second toothed face 271 is formed at a rear end of the second retaining block 27, so that the first and the second toothed face 181, 271 are faced in two opposite directions.

Please refer to FIGS. 4 to 6. When the male member 10 is initially plugged into the female member 20, as shown in FIG. 4, the outer side surfaces 14 of the two elastic retaining arms 12 are in contact with and pushed inward by the inner sidewall surfaces 24 of the receiving spaces 22, causing the two retaining arms 12 to elastically shift inward. At this point, the guide way 19 between the width-reduced wall 17 and the first retaining block 18 on each retaining arm 12 is directed toward the second retaining block 27 formed in a corresponding receiving space 22 of the female member 20.

When the male member 10 is further pushed into the female member 20 as shown in FIG. 5, a position of the second retaining block 27 relative to the guide way 19 gradually changes. When the two curved outer side surfaces 14 of the retaining arms 12 are completely located in and spring from the side openings 25 of the female member 20, the first retaining block 18 on each retaining arm 12 is protrudes through a top opening 28 in an upper surface of the female member 20 is aligned with the second retaining block 27 with the first toothed face 181 engaged with the second toothed face 271 and the shoulder portion 15 abutted on the end wall surface 26 of the side opening 25.

At this point, when the whole buckle is subjected to pull forces in two opposite directions, the first and the second toothed faces 181, 271 are caused to more tightly engage with one another, as shown in FIG. 6, making the whole buckle a strengthened force-bearing structure. On the other hand, when it is desired to open the buckle, simply inward compress the two curved outer side surfaces 14 of the two elastic retaining arms 12 to release the male member 10 from the female member 20.

With the above-described structure, the low-profile heavy-duty buckle of the present invention with the male and the female member 10, 20 in a mutually connected state provides a largely increased force-bearing strength not only because the abutment of the shoulder portions 15 on the end wall surfaces 26 of the side openings 25, but also the firm engagement of the first toothed face 181 with the second toothed face 271 that forms a structure with an enhanced resisting strength. The low-profile buckle of the present invention with the above-described improved structure provides a force-bearing strength about 50 kgs, which is twice as much as a conventional low-profile buckle having a belt of the same material connected thereto and providing a force-bearing strength from 20 to 25 kgs.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A low profile heavy-duty buckle comprising:

a) a male member being movable between removed, inserted, and loaded positions, and having:

i) a main male body with a transverse first slot;

ii) two retaining arms spaced part and protruding outwardly from the main male body, each retaining arm of the two retaining arms having a curved outer side surface having a shoulder portion and a first retaining block having a front face with a first toothed surface; and iii) a central guide arm located between the two retaining arms and protruding outwardly from the main male body; and b) a female member having:

i) a transverse second slot located at a first end thereof;

ii) two receiving spaces formed in a second end thereof, each of the two receiving spaces having a second retaining block forming a top opening in an upper surface of the female member, the second retaining block having a second toothed surface defining an edge of the top opening;

iii) two side openings located on opposing sides thereof, one side opening of the two side openings communicating with each of the two receiving spaces; and iv) a central guide channel located between the two receiving spaces;

wherein, when the male member is located in the removed position, the male member and the female member are separated, the central guide arm is located in the central guide channel, wherein, when the male member is located in the inserted position, one of the two retaining arms are located in each of the two receiving spaces, the curved outer side surface of one of the of the two retaining arms protruding outwardly from each of the two side openings, the shoulder portion of one of the of the two retaining arms engaging an end wall surface of each of the two side openings preventing the male member and the female member from separating, the first toothed surface of one first retaining block is spaced apart from the second toothed surface of each second retaining block of each of the two receiving spaces; and wherein, when the male member is located in the loaded position, the first toothed surface of one first retaining block engaging the second toothed surface of each second retaining block of each of the two receiving spaces through the first retaining block moving upwards through the top opening of the female upper surface to thereby prevent the male member and the female member from separating.

2. The low profile heavy-duty buckle according to claim 1, wherein the first retaining block protrudes upwardly from a top of each of the of the two retaining arms, the second retaining block protrudes downwardly from a top of each of the two receiving spaces.

3. The low profile heavy-duty buckle according to claim 1, wherein the male member is located in the loaded position when a separating force is applied to the transverse first slot in a first direction and the transverse second slot in a second direction opposite the first direction to separate the male member from the female member.

4. The low profile heavy-duty buckle according to claim 1, wherein each of the two receiving spaces has an inner side wall surface engaging and deforming one of the two retaining arms as the male member is inserted into and removed from the female member.

5. The low profile heavy-duty buckle according to claim 1, wherein the central guide channel communicates with the transverse second slot.

6. The low profile heavy-duty buckle according to claim 1, wherein each retaining arm of the two retaining arms has a width reduced wall and a guide way located between the width reduced wall and the first retaining block.

7. The low profile heavy-duty buckle according to claim 6, wherein each width reduced wall includes a guiding beveled surface.

8. The low profile heavy-duty buckle according to claim 6, wherein each retaining arm of the two retaining arms has an extension portion connecting the width reduced wall to the first retaining block.

9. The low profile heavy-duty buckle according to claim 1, wherein the central guide arm has a length longer than a length of the two retaining arms.

* * * * *